United States Patent [19]

Machmer

[11] Patent Number: 4,982,646

[45] Date of Patent: Jan. 8, 1991

[54] BARRELED WEAPON

[75] Inventor: Wilhelm Machmer, Nuremberg, Fed. Rep. of Germany

[73] Assignee: Diehl GmbH & Co., Nuremberg, Fed. Rep. of Germany

[21] Appl. No.: 523,719

[22] Filed: May 15, 1990

[30] Foreign Application Priority Data

Jun. 12, 1989 [DE] Fed. Rep. of Germany ..... 3919151

[51] Int. Cl.[5] ..... F41F 1/06; F41F 23/06

[52] U.S. Cl. ..... 89/1.35; 89/1.3; 89/37.05

[58] Field of Search ..... 89/1.3, 1.35, 37.05

[56] References Cited

U.S. PATENT DOCUMENTS

| | | | |
|---|---|---|---|
| 3,892,163 | 7/1975 | Asikainen | 89/37.05 |
| 3,894,473 | 7/1975 | Marest et al. | 89/37.05 |
| 4,198,897 | 4/1980 | Lipp et al. | 89/37.05 |
| 4,495,852 | 1/1985 | Winkler et al. | 89/46 |
| 4,669,357 | 6/1987 | von Laer et al. | 89/1.3 |
| 4,753,156 | 6/1988 | Winkler et al. | 89/37.05 |

*Primary Examiner*—David H. Brown

*Attorney, Agent, or Firm*—Scully, Scott, Murphy & Presser

[57] ABSTRACT

A barreled weapon including a forward barrel segment which is tiltable about a trunnion through the intermediary of an actuating arrangement, and additionally includes a rear barrel segment which is similarly pivotable about the trunnion whereby the barrel segments, when oriented in their coaxial position, are sealed through the utilization of a sealing ring at a joint or separating location without necessitating any axial displacement of one of the barrel segments. The weapon includes a casing which is conducted along a screwthread and wherein, in the coaxial position of the barrel segments, the actuating arrangement rotates the casing so as to cause the latter, in conjunction with the sealing ring which is arranged thereon, to axially slide over the separating location between the barrel segments.

7 Claims, 4 Drawing Sheets

BARRELED WEAPON

BACKGROUND OF THE INVENTION

1. Field of the Invention

The present invention relates to a barreled weapon including a forward barrel segment which is tiltable about a trunnion through the intermediary of an actuating arrangement, and additionally includes a rear barrel segment which is similarly pivotable about the trunnion whereby the barrel segments, when oriented in their coaxial position, are sealed through the utilization of a sealing ring at a joint or separating location without necessitating any axial displacement of one of the barrel segments.

2. Discussion of the Prior Art

A barreled weapon of the type mentioned hereinabove is described in the disclosure of U.S. Pat. No. 4,669,354 commonly assigned to the assignee of the present application. In order to be able to implement the loading of the barreled weapon, the forward barrel segment is pivoted into a horizontal position relative to the rear barrel segment. Subsequent to the sliding in of an article of ammunition, the forward barrel segment is then pivoted in front of the rear barrel segment. The ammunition thereafter drops down onto a firing pin contained in the rear barrel segment. This barreled weapon is adapted for use as a steep-angle firing weapon, such as a mortar. The angle of elevation is set or adjusted through a common pivoting of the two barrel segments about the trunnion.

In the specification of German Laid-Open patent application Ser. No. 22 38 345 there is set forth a description of a grenade launcher in which the forward barrel segment, when swung away from the rear barrel segment, is to be loaded from below with ammunition. In order to seal the two barrel segments with respect to each other at the joint or separating location, the forward barrel segment is axially slid towards the rear barrel segment. This is carried out through the utilization of the same actuating arrangement by means of which the forward barrel segment is also tiltable. In order to implement the latching together of the two barrel segments, provision is made for a latching sleeve. This sleeve is equipped with a stop for the ammunition, which will prevent any premature sliding of the ammunition into the rear barrel segment.

SUMMARY OF THE INVENTION

Accordingly, it is an object of the present invention to provide a barreled weapon of the above-mentioned type, in which the sealing action between the barrel segments is improved to a substantial degree. The above object is inventively achieved for a barreled weapon of the above-mentioned type, in that there is provided a closure sleeve or breech casing which is conducted along a screwthread and wherein, in the coaxial position of the barrel segments, the actuating arrangement rotates the casing so as to cause the latter, in conjunction with the sealing ring which is arranged thereon, to axially slide over the separating location between the barrel segments.

The casing which is slid over the joint or separating location, on the one hand, ensures the coaxial orientation of the barrel segments, which is a prerequisite for the presence of a secure sealing action. On the other hand, the sealing ring, which has been pushed by the closure sleeve or casing over the separating location, prevents any egress of gases which are generated during firing. An axial latching of the barrel segments with respect to each other is not effectuated by the casing. The rear barrel is guided in the axially movable.

A further advantage of the invention resides in that, through the intermediary of the same actuating arrangement by means of which the forward barrel segment can be rendered tiltable, also the closure sleeve or casing is slid over the separating location due to its screwthreaded conductance.

Preferably, the screwthread on which the casing is conducted is arranged on the rear barrel segment, and the casing pushes the sealing ring over the forward barrel segment. The screw thread itself hereby assists in the sealing action. At a forwardly advanced casing or sleeve, the separating location of the two barrel segment is located for the screwthread and the sealing ring. However, it would also be possible to arrange two sealing rings on the casing whereby, in the forwardly advance position of the casing, the separating location would be located between the two sealing rings.

In order to implement the driving of the casing, pursuant to a specific embodiment of the invention, this structure incorporates a ring gear with which there interdigitates a first gear drive which is driveable from the actuating arrangement. Consequently, the turning of the casing is rendered possible by operation of a simple pivot lever on the actuating arrangement.

Pursuant to a modification of the invention, the actuating arrangement possesses a second gear drive through the action of which the forward barrel segment which can be tilted. The first gear drive is blocked when the second gear drive is in an operative condition.

The second gear drive is blocked when the first gear drive is in an operative condition. As a result thereof, this will ensure that the casing will only then first be displaced when the barrel segments are coaxially oriented. On the other hand, this will then also ensure that, upon the reverse actuation of the actuating arrangement, the casing will be initially retracted and thereafter there follows the tilting of the forward barrel segment.

Pursuant to a preferred embodiment of the invention, a stop for the ammunition is arranged in the forward barrel segment which, towards the end of the displacement of the casing over the separating location between the barrel segments, will pivot out of the forward barrel segment. Consequently, this will afford for the ammunition to only slide into the rearward barrel segment and to be fired therefrom, when the sealing has been implemented.

Preferably, the casing or closure sleeve itself will pivot the stop for the ammunition out of the forward barrel segment during its advance over the separating location by means of a push rod. In view of the foregoing, it becomes unnecessary to provide a separate coupling between the actuating arrangement and the stop for the ammunition contact.

Pursuant to a further configuration of the invention, the actuating arrangement possesses a latching device which blocks the actuating arrangement after the forward advance of the casing or closure sleeve. The latching device prevents the actuating arrangement from being actuated in the opposite direction subsequent to the sliding of the ammunition into the rear barrel segment. The release of the latching device is effected after the firing of the ammunition. The latching device can either be manually released or also in response to the gas pressure which is generated by the firing.

BRIEF DESCRIPTION OF THE DRAWINGS

Reference may now be had to the following detailed description of an advantageous and exemplary embodiment of the invention, taken in conjunction with the accompanying drawings; in which.

DETAILED DESCRIPTION

Figure 1:
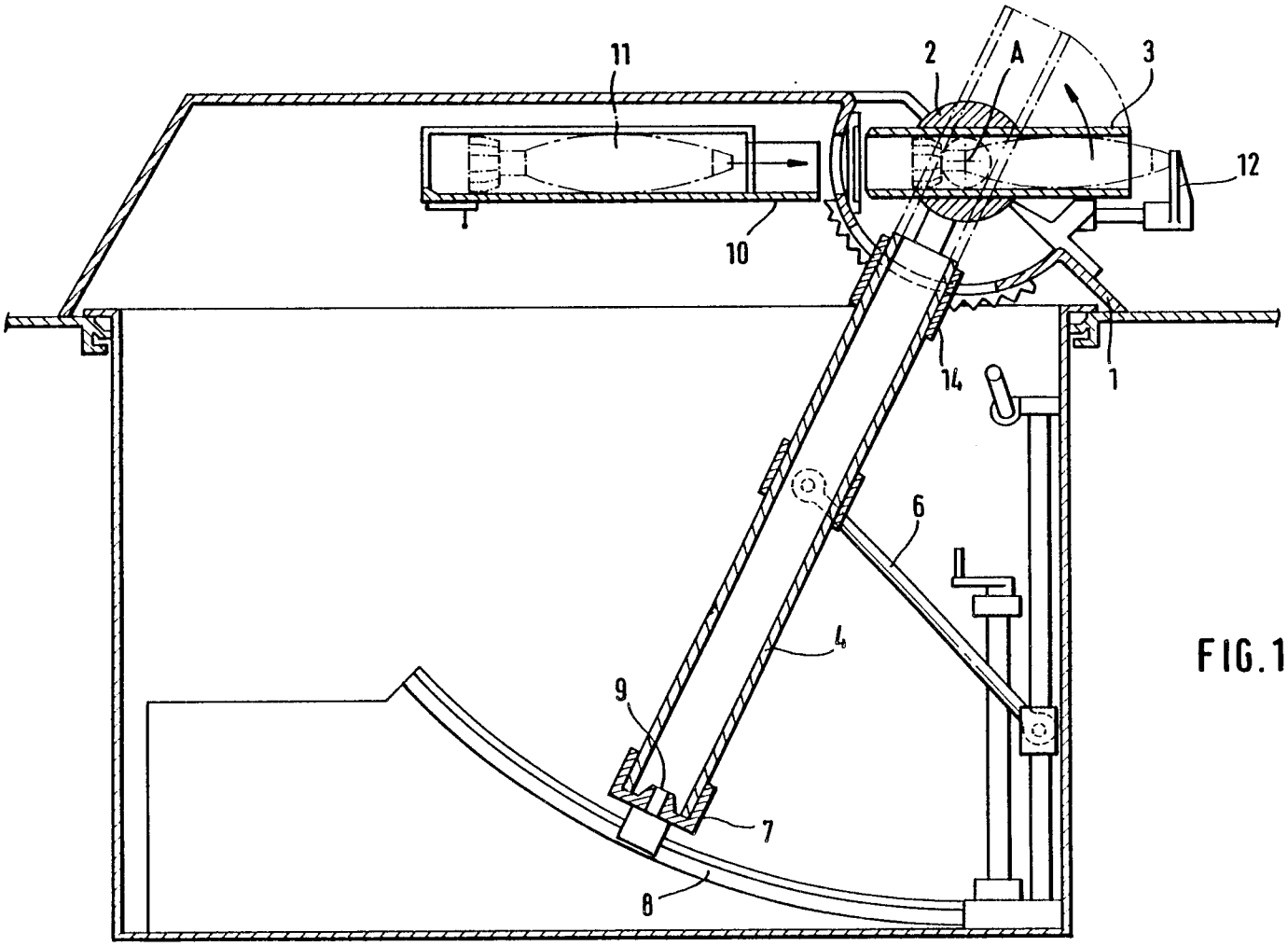
FIG. 1 illustrates, generally schematically, a barreled weapon shown in the loading position.

A barreled weapon is mounted on a carrier 1, for example, in a vehicle. The barreled weapon is supported on a trunnion 2 so as to be pivotable about an axis of elevation A. The barreled weapon possesses a forward barrel segment 3 and a rear barrel segment 4. Both of the barrel segments 3, 4 are pivotably supported on the trunnion 2.

Figure 2:
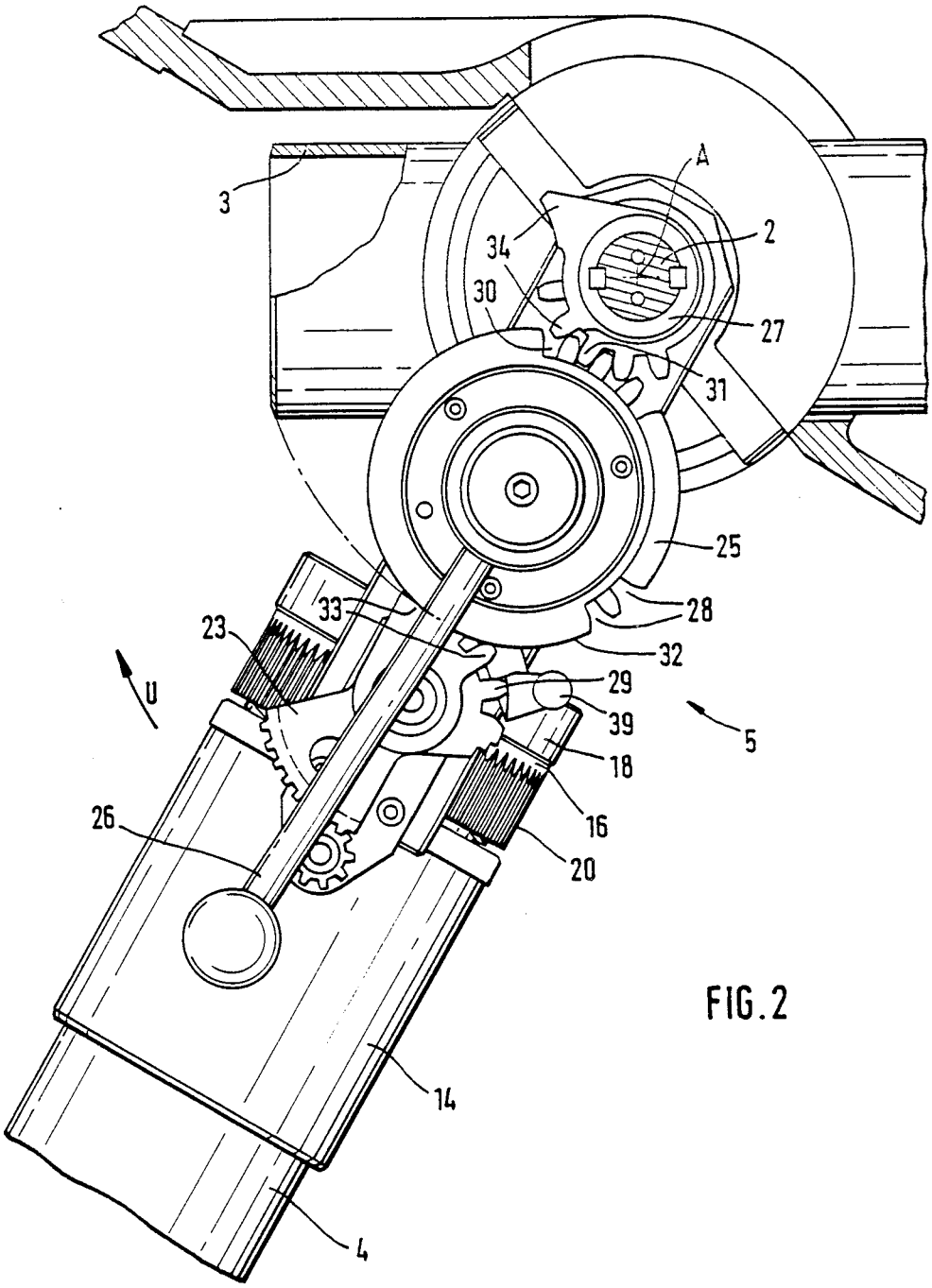
FIG. 2 illustrates the actuating arrangement for the barreled weapon in the loading position, shown on an enlarged scale relative to FIG. 1.
Figure 3:
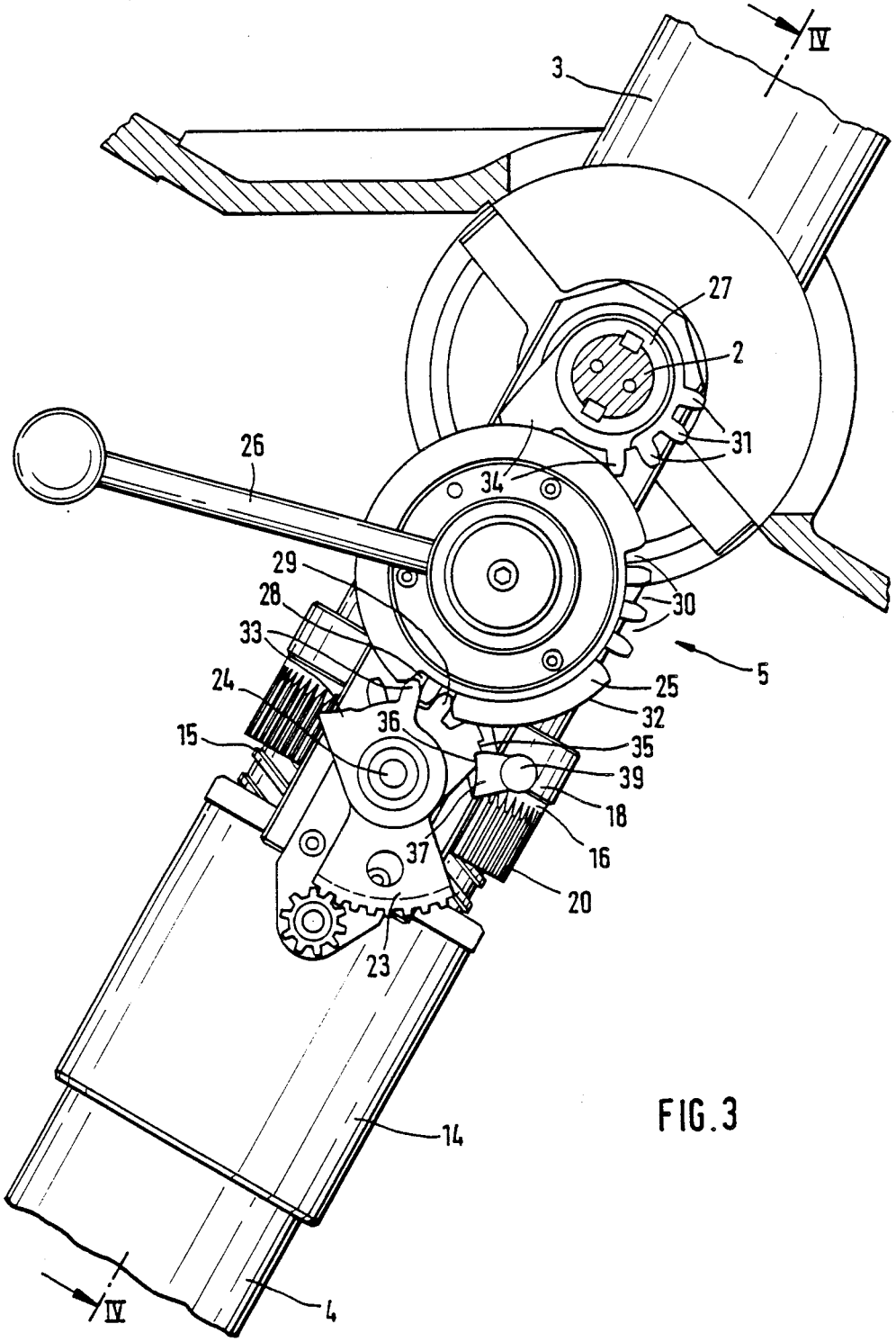
FIG. 3 illustrates the actuating arrangement in the firing position.
Figure 4:
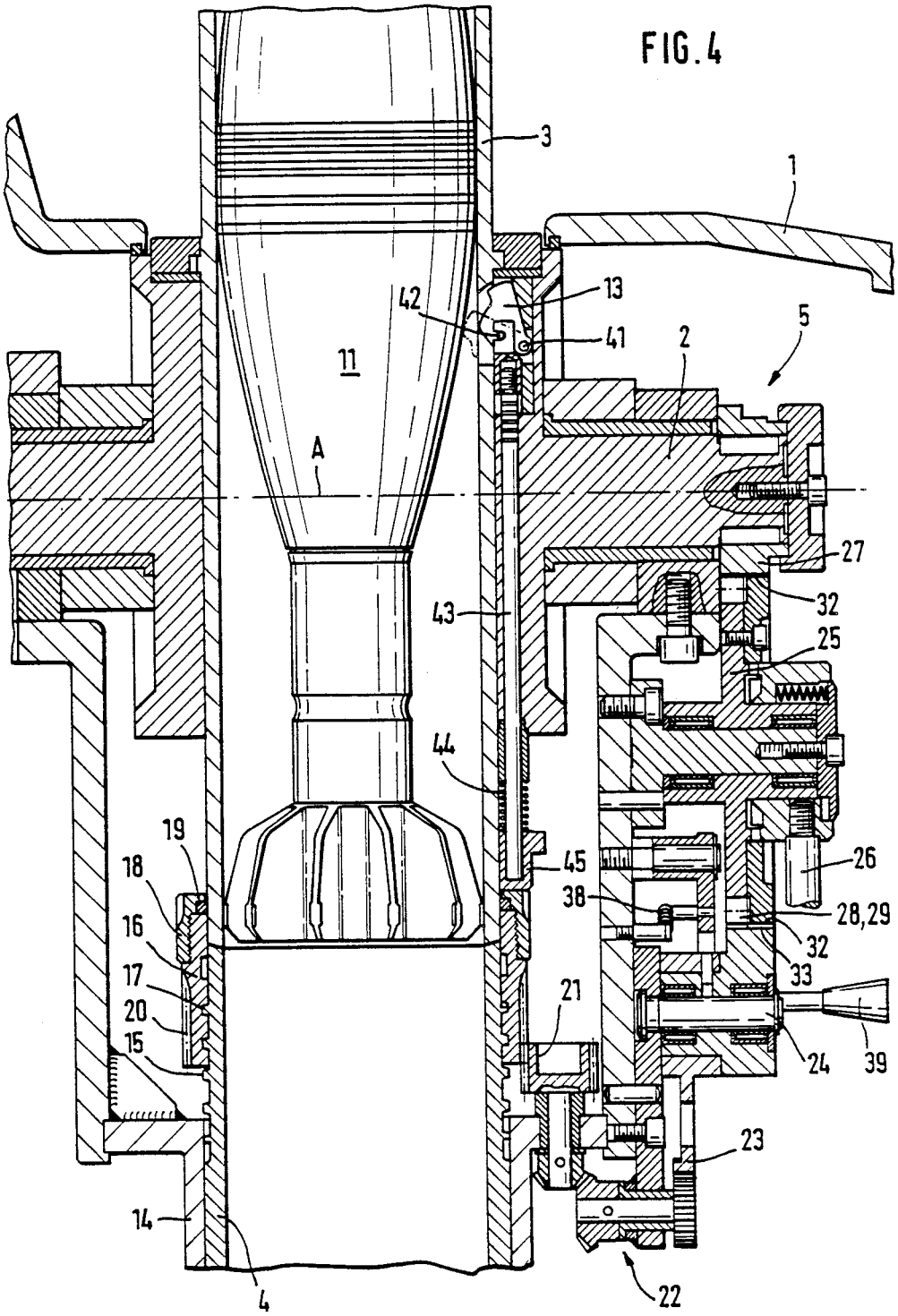
FIG. 4 illustrates a fragmentary longitudinal sectional view through the barreled weapon in the firing position, taken essentially along line IV—IV in FIG. 3.

The forward barrel segment 3 is pivotable about the trunnion 2 with regard to the rear barrel segment 4 through the intermediary of a actuating arrangement 5, the latter of which may be more specifically ascertained from FIGS. 2 through 4 of the drawings. A setting device 6 engages the rear barrel segment 4, and through which there can be adjusted and set elevation for the rear barrel segment 4. The rear barrel segment 4 possesses a base portion 7 which is conducted along a slide or guide rail 8, and which base portion is equipped with striker or firing pin 9.

In the loading position, as is shown in FIG. 1, the forward barrel segment 3 is pivoted into a horizontal position relative to the rear barrel segment 4. Hereby, the segment 3 stands coaxially with regard to a loading tray 10 from which an article of ammunition 4 can be inserted into the forward barrel segment 3. A head end stop 12 is provided in order to avoid a pushing out of the ammunition from the forward barrel segment 3. The stop 13, which is initially displaced by the inserted projectile, snaps into place behind the projectile at the end of the stroke and secures the projectile against any premature sliding off.

The rear barrel segment 4 is seated in a barrel holder 14 which is pivotably supported on the trunnion 2. A screwthread 15 is formed on the rear barrel segment 4, along which screwthread there is guided a closure sleeve or casing 16 by means of an engaging internal screwthread 17. Through the interposition of a cap 18, a sealing ring 19 is mounted on the casing 16. The casing 16 has the exterior thereof provided with a gear ring 20.

A pinion 21 of a first gear drive 22 interdigitates with the gear ring 20, through which there can be driven a gear segment 23, the latter of which is pivotable about an axis 24.

Cooperating with the gear segment 23 is a wheel 25 of the actuating arrangement 5, having a manually actuatable pivot lever 26 fastened thereto.

Moreover, a second gear segment 27 operates in conjunction with the gear wheel 25 as a second gear drive, which is pivotable about the trunnion 2 and to which there is fastened the forward barrel segment 13.

The gear wheel 25 possesses tooth gaps or interspaces 28 for receipt of the gear teeth 29 of the gear segment 23. Moreover, the gear wheel 25 includes tooth gaps 30 for the engaging receipt of gear teeth 31 from the second gear segment 27. In addition to the foregoing, the gear wheel 25 is equipped with a blocking surface 32. This blocking surface has locking protuberances 33 on the gear segment 23 and locking protuberances 34 on the gear segment 27 operatively associated therewith. The blocking surfaces 32 and the locking protuberances 33, 34, on the one hand, and the tooth gaps 28, 30 as well as the gear teeth 29, 31, on the other hand, are arranged in different parallel planes.

Two steps 35, 36 are provided on the gear segment 23. These steps have a latching pawl 37 operatively associated therewith. The latching pawl 37 is subjected to the action of a tension spring 38. By means of the actuation of a grip member 39, the latching pawl 37 is adapted to be lifted away from the steps 35, 36.

An ammunition limit stop 13, 40 on the forward barrel segment 3 is supported so as to be pivotable about an axis 41. A push rod 43 engages against a pin 40 of the stop element 40, which is subjected to a force by a spring 44. The push rod 43 is connected with a glide member 45 which can be subjected to a force from the cap 18 on the casing 16, as is shown in FIG. 4.

The functioning mode of the above-described arrangement is generally as follows:

In the loading position as shown pursuant to FIGS. 1 and 2, the gear teeth 31 of the second gear segment 27 engage into the tooth gaps 30 which are present between the gear teeth. The locking protuberances 33 on the gear segment 23 contact against the blocking surface 32. The latching pawl 37 rests on the head of the gear tooth 29. After the insertion of a projectile from the loading tray 10 into the forward barrel segment 3, the pivot lever 26 is actuated by being turned in a clockwise direction U. Thereby, as a result of the engagement of the gear teeth 31 into the tooth gaps 30 present between the gear teeth, the forward barrel segment 3 is pivoted. The locking protuberances 33 on the gear segment 23 glide along the blocking surface 32, so that the gear segment 23 will not move and, consequently, also the casing 16 remains at a standstill.

When the forward barrel segment 3 is positioned coaxially with respect to the rear barrel segment 4, then the locking protuberances 34 contact against the blocking surface 32.

Upon the further movement of the pivot lever 26, the gear teeth 29 engage into the tooth gaps 28 present between the teeth so as to now cause a pivoting movement of the gear segment 23. Thereby, by means of the gear drive 22, the casing 16 is turned along the length of screwthread 15 so as to axially slide itself over the joint or separating location between the forward barrel segment 3 and the rear barrel segment 4. Thereby, the sealing ring 19 is slid over the forward barrel segment 3. The latching pawl 37 engages the first step 35, so that the pivot lever 26 can no longer be readily moved back.

During the continued movement of the pivot lever 26 in the clockwise direction U, the casing 16 in conjunction with the ca 18 strikes against the push rod 43 so as to cause the latter to swing the stop element 13 out of the forward barrel segment 3. Prior to the foregoing, the latching pawl 37 has reached the blocking step 36. The pivot lever 26, in its end position, lies against the gear wheel 25 through a contacting against the edge x, and the ammunition 11 slides into the rear barrel segment 4; as is shown in FIGS. 3, 4.

In the event that a resetting is to be carried out subsequent to the firing, then by means of actuation of the grip element 39, the latching pawl 37 is to be released from the step 36. Thereafter, through implementing a movement of the pivot lever 26 in opposite to the clockwise direction U, the forward barrel segment 3 is then moved into its loading position. Hereby, the casing 16 is thereafter pulled back over the separating location between the two barrel segments 3, 4 while the gear teeth 29 engage into the tooth gaps 28 of between the gear teeth, so that the casing 16 is rotated back along the screwthread 15. Through the pulling back of the casing 16, the stop element 13 is brought again into that particular position in response to the action of the spring 44, in which it will not allow the an article ammunition 11 to directly drop into the rear barrel segment 4. Thereafter, the gear teeth 31 engage into the tooth gaps 30 so that the forward barrel segment 3 is tilted away from the rear barrel segment 4.

What is claimed is:

1. A barreled weapon including a forward barrel segment; actuating means for tilting said forward barrel segment about a trunnion; a rear barrel segment which is pivotable about said trunnion; a sealing ring for sealing a separating location between said barrel segments in the coaxial position of said segments in the absence of an axial displacement of any of said barrel segments; a casing member having a screwthread formed thereon, said actuating means rotating said casing in the coaxial position of said barrel segments whereby said casing in conjunction with the sealing ring arranged thereon axially slides over said separating location between said barrel segments.

2. A barreled weapon as claimed in claim 1, wherein the screwthread along which said casing is conducted is formed on said rear barrel segment, and said casing slides said sealing ring over the forward barrel segment.

3. A barreled weapon as claimed in claim 1, wherein said actuating means includes latching means for blocking said actuating means subsequent to the advance of said casing over said separating location.

4. A barreled weapon as claimed in claim 1, wherein said casing includes a gear ring; a first gear drive engaging said gear ring, said gear drive being operable from said actuating means.

5. A barreled weapon as claimed in claim 4, wherein said actuating means includes a second gear drive for tilting said forward barrel segment, said first gear drive being blocked when said second gear drive is operative and said second gear drive being blocked when said first gear drive is operative.

6. A barreled weapon as claimed in claim 1, wherein a stop for ammunition is located on said forward barrel segment, said stop being swung out of the forward barrel segment towards the end of the displacement of the casing over the separating location between said barrel segments.

7. A barreled weapon as claimed in claim 6, wherein the casing during the advance thereof over the separating location between the barrel segments actuates a push rod for swinging the stop for ammunition out of the forward barrel segment.

* * * * *